US008844238B2

(12) United States Patent
Baldoni et al.

(10) Patent No.: US 8,844,238 B2
(45) Date of Patent: Sep. 30, 2014

(54) REINFORCEMENT SUPPORT MEMBER AND KIT

(71) Applicants: Edwin Joseph Baldoni, Union Dale, PA (US); Dario Joseph Baldoni, Boston, MA (US)

(72) Inventors: Edwin Joseph Baldoni, Union Dale, PA (US); Dario Joseph Baldoni, Boston, MA (US)

(73) Assignee: Concrete Countertop Solutions, Inc., Clarks Summit, PA (US)

( * ) Notice: Subject to any disclaimer, the term of this patent is extended or adjusted under 35 U.S.C. 154(b) by 0 days.

(21) Appl. No.: 14/063,467

(22) Filed: Oct. 25, 2013

(65) Prior Publication Data

US 2014/0115995 A1 May 1, 2014

Related U.S. Application Data

(60) Provisional application No. 61/795,802, filed on Oct. 26, 2012.

(51) Int. Cl.
*E04C 5/16* (2006.01)
*E04H 12/00* (2006.01)

(52) U.S. Cl.
CPC ..... *E04C 5/168* (2013.01); *E04C 5/166* (2013.01)
USPC ..... 52/687; 52/637; 52/649.1; 52/677; 52/682; 52/683; 52/633; 52/646; 52/649.8; 52/649.3; 52/645

(58) Field of Classification Search
CPC ..... E04C 5/20; E04C 5/16; E04C 5/162; E04C 5/166; E04C 5/168; E04C 5/18
USPC ..... 52/687, 637, 649.1, 677, 682, 683, 633, 52/646, 649.8, 649.3, 645, 678, 680; D8/354, 380, 349, 384
See application file for complete search history.

(56) References Cited

U.S. PATENT DOCUMENTS 4,060,954 A * 12/1977 Liuzza ..... 52/677
4,594,205 A 6/1986 Wunderlich, Jr. et al.
4,655,023 A * 4/1987 Yung ..... 52/685
5,555,693 A * 9/1996 Sorkin ..... 52/689

(Continued)

OTHER PUBLICATIONS

Lowes; Shop Plastic Rebar Chair at Lowes.com; http://www.lowes.com/pd_211658-46086-105247_0_?productId=3363670; 1 page; downloaded from the Internet Oct. 16, 2013.

(Continued)

*Primary Examiner* — Mark Wendell
(74) *Attorney, Agent, or Firm* — Morgan, Lewis & Bockius LLP

(57) ABSTRACT

A support member for supporting a reinforcement material in a composite structure comprises a base member and first and second vertical leg members on opposing sides of the base member. The first and second vertical leg members have a first height relative to the base member. The first and second vertical leg members each have an opening configured to receive at least one strand of the at least one layer of reinforcement material. Third and fourth vertical leg members are on opposing sides of the base member and have a second height relative to the base member different from the first height of the first and second vertical leg members. The third and fourth vertical leg members each have an opening configured to receive at least one strand of the at least one layer of reinforcement material.

13 Claims, 7 Drawing Sheets

(56) References Cited

U.S. PATENT DOCUMENTS

| | | | | |
|---|---|---|---|---|
| 6,092,960 | A | 7/2000 | McCallion | |
| 6,354,054 | B1 | 3/2002 | Verelli et al. | |
| 6,837,017 | B2 | 1/2005 | Hardy, Jr. et al. | |
| 6,883,289 | B2 | 4/2005 | Juedes et al. | |
| D548,053 | S | 8/2007 | Erickson et al. | |
| 7,328,538 | B2 | 2/2008 | Trangsrud | |
| 7,451,580 | B2 * | 11/2008 | Kelly et al. | 52/687 |
| 7,870,702 | B2 | 1/2011 | McKay | |
| 8,028,490 | B2 | 10/2011 | Kelly et al. | |
| 2007/0157542 | A1 * | 7/2007 | Peterson, Jr. | 52/677 |
| 2011/0214381 | A1 * | 9/2011 | Alfonso | 52/685 |

OTHER PUBLICATIONS

Alibaba; Plastic Rebar Chair Spacer; http://www.alibaba.com/product-gs/230601864/Plastic_rebar_chair_spacer_plastic_rebar.html; 2 pages; downloaded from the internet Oct. 16, 2013.

RebarPlastics; Plastic Rebar Accessories; http://www.rebarplastics.com/; 2 pages; downloaded from the internet Oct. 16, 2013.

Alibaba; Plastic Rebar Chair; http://www.alibaba.com/showroom/plastic-rebar-chair.html; 7 pages; downloaded from the Internet Oct. 16, 2013.

Concrete Protection Products, Inc.; Product Guide Specification; http://www.fiberglassrebar.com/VROD%20CSI%20spec.pdf; 5 pages; downloaded from the Internet Oct. 16, 2013.

* cited by examiner

REINFORCEMENT SUPPORT MEMBER AND KIT

CROSS-REFERENCE TO RELATED APPLICATIONS

This application claims the benefit of U.S. Provisional Patent Application No. 61/795,802 filed Oct. 26, 2012 entitled "Z Clip", which is incorporated by reference herein in its entirety.

BACKGROUND OF THE INVENTION

The present invention generally relates to a reinforcement support member and kit, and more particularly in some embodiments, to a reinforcement support member and kit used in the construction of a composite or concrete slab.

BRIEF SUMMARY OF THE INVENTION

In one embodiment there is a support member for supporting a reinforcement material in a composite structure, the reinforcement support member comprising: a base member; first and second vertical leg members on opposing sides of the base member and having a first height relative to the base member, the first and second vertical leg members each having an opening configured to receive at least one strand of the at least one layer of reinforcement material, third and fourth vertical leg members on opposing sides of the base member and having a second height relative to the base member different from the first height of the first and second vertical leg members, the third and fourth vertical leg members each having an opening configured to receive at least one strand of the at least one layer of reinforcement material.

In one embodiment, the first vertical leg member is configured to be removed from the base member without the use of a tool. In one embodiment, at least one of the first, second, third and fourth vertical leg members includes a horizontal notch proximate the base member. In one embodiment, the base member includes an opening configured to accommodate a mechanical fastener. In one embodiment, the opening is generally aligned between the first, second, third and fourth vertical leg members. In one embodiment, a bottom surface of the base member includes an adhesive layer. In one embodiment, at least one of the openings of the first, second, third and fourth vertical leg members is configured to receive two or more layers of the reinforcement material. In one embodiment, the first, second, third, and fourth vertical leg members are spaced from and generally parallel to one another. In one embodiment, the first, second, third, and fourth vertical leg members are coupled to one another by the base member only.

In another embodiment there is a support member for supporting a reinforcement material in a composite structure, the reinforcement support member comprising: a base member having an opening configured to receive a fastener; first and second vertical leg members on opposing sides of the base member, the opening of the base member being generally aligned with the first and second vertical leg members, the first and second vertical leg members each having an opening configured to receive at least one strand of the at least one layer of reinforcement material, the first and second vertical leg members being coupled to one another by the base member only.

In another embodiment there is a kit for forming a composite structure comprising: at least one layer of reinforcement material, each layer of the at least one layer of reinforcement material comprising a mesh of parallel and perpendicular strands forming a grid; and a support comprising: a base member; first and second vertical leg members on opposing sides of the base member and having a first height relative to the base member, the first and second vertical leg members each having an opening configured to receive at least one strand of the at least one layer of reinforcement material; third and fourth vertical leg members on opposing sides of the base member and having a second height relative to the base member different from the first height of the first and second vertical leg members, the third and fourth vertical leg members each having an opening configured to receive at least one strand of the at least one layer of reinforcement material.

In one embodiment, the first, second, third and fourth vertical leg members are each removeable from the base member. In one embodiment, the first, second, third and fourth vertical leg members each include a notch proximate the base member, the notch being a line of weakness configured to break through the first, second, third or fourth vertical leg member when a top of the first, second, third or fourth vertical leg member is moved a sufficient distance relative to the base member. In one embodiment, the first and second vertical leg members are spaced a first distance from one another, the third and fourth vertical leg members are spaced a second distance from one another, each parallel strand of a layer of the reinforcement material being spaced a third distance from one another, at least one of the first and second distances being greater than the third distance. In one embodiment, the at least one layer of reinforcement material includes fiberglass.

In another embodiment there is a kit for forming a composite structure comprising: at least one layer of reinforcement material, each layer of the at least one layer of reinforcement material comprising a mesh of parallel and perpendicular strands forming a grid; and a support comprising: a base member; first and second vertical leg members on opposing sides of the base member, the first and second vertical leg members each having an opening configured to receive at least one strand of the at least one layer of the reinforcement material, wherein a width of the base member is larger than a width of a space formed between the parallel and perpendicular strands of the at least one layer of reinforcement material. In a further embodiment, the kit comprises a fastener system configured to engage the base member and secure the base member to a substrate. In one embodiment, the fastener system includes an opening in the base member and a screw configured to extend through the opening. In one embodiment, the at least one layer of reinforcement material includes fiberglass.

BRIEF DESCRIPTION OF THE SEVERAL VIEWS OF THE DRAWINGS

The foregoing summary, as well as the following detailed description of embodiments of the reinforcement support member and kit, will be better understood when read in conjunction with the appended drawings of an exemplary embodiment. It should be understood, however, that the invention is not limited to the precise arrangements and instrumentalities shown.

In the drawings.

DETAILED DESCRIPTION OF THE INVENTION

Figure 1A:
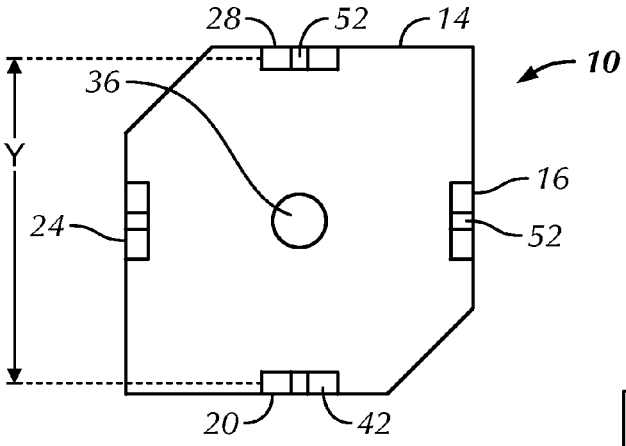
FIG. 1A is a top plan view of a support member in accordance with an exemplary embodiment of the present invention.
Figure 1B:
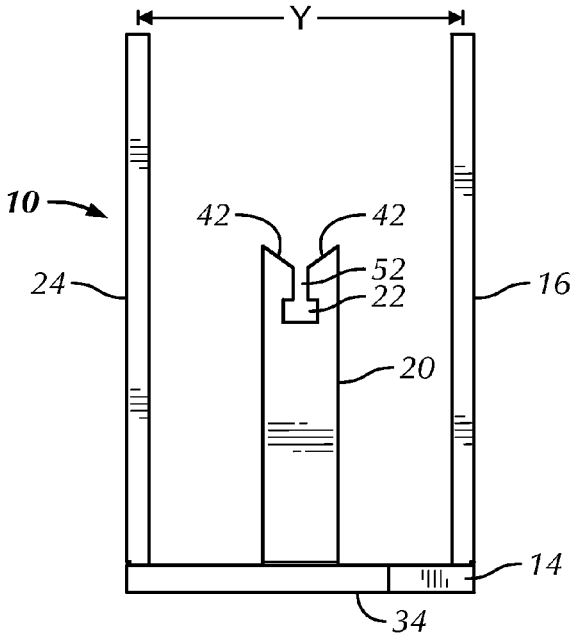
FIG. 1B is a front elevational view of the support member shown in FIG. 1A.
Figure 1C:
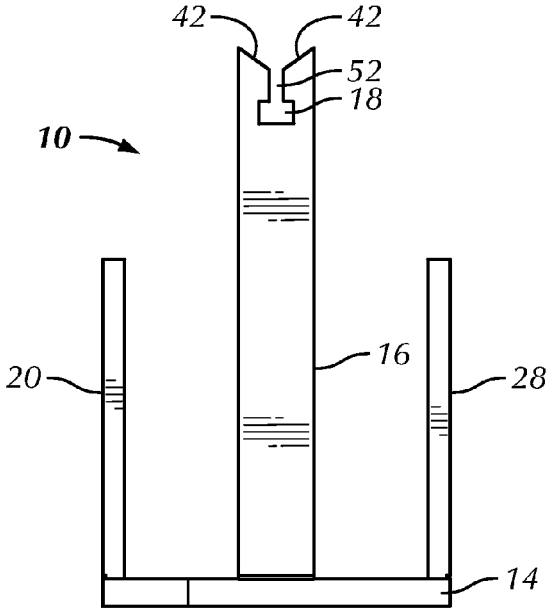
FIG. 1C is a right side elevational view of the support member shown in FIG. 1A.
Figure 2:
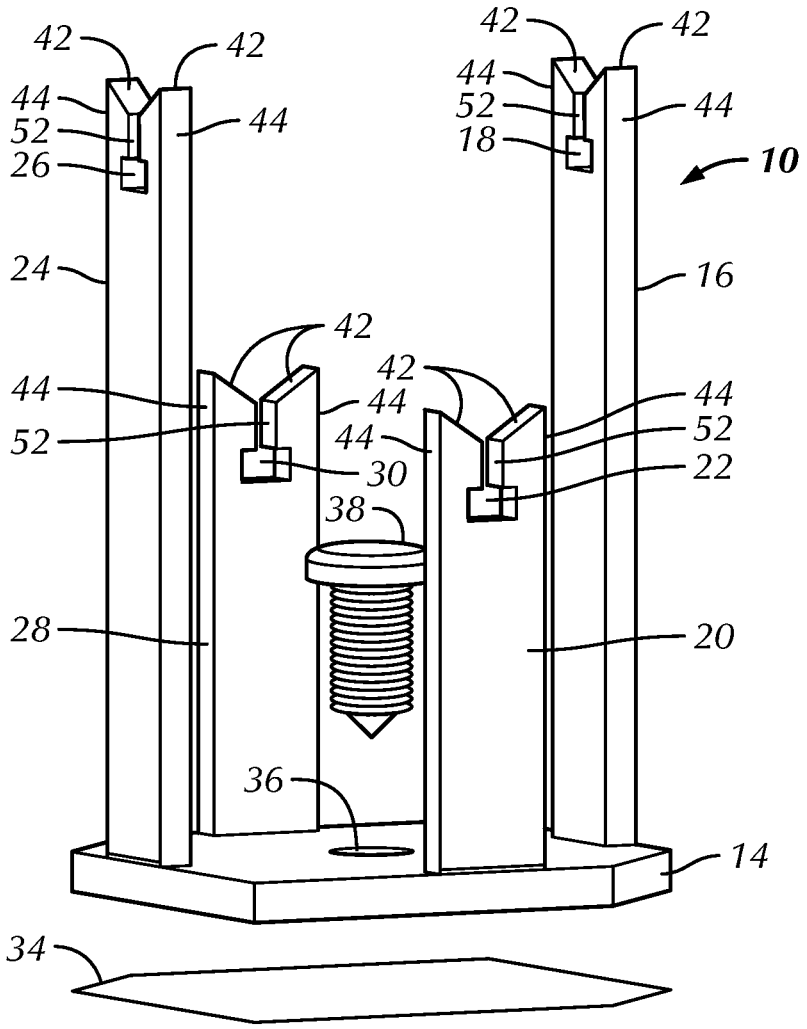
FIG. 2 is a perspective view of the support member of FIG. 1A shown spaced from an adhesive layer and a fastener.

Referring to FIGS. 1-8, wherein like reference numerals indicate like elements throughout, there is shown various views of a support member 10 for supporting a reinforcement material 12, in accordance with exemplary embodiments of the present invention.

Figure 7:
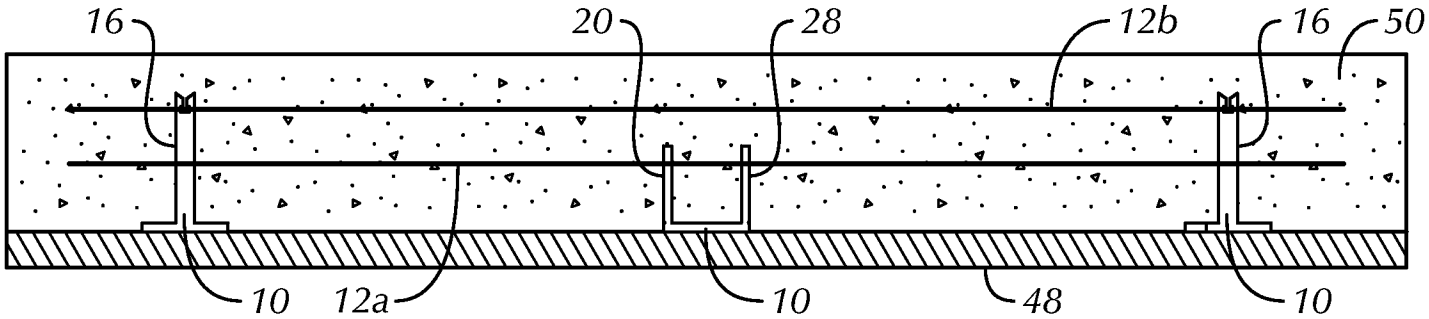
FIG. 7 is a side view of a composite slab having three support members supporting two layers of reinforcement material at different heights from one another in accordance with an exemplary embodiment of the present invention.
Figure 8:
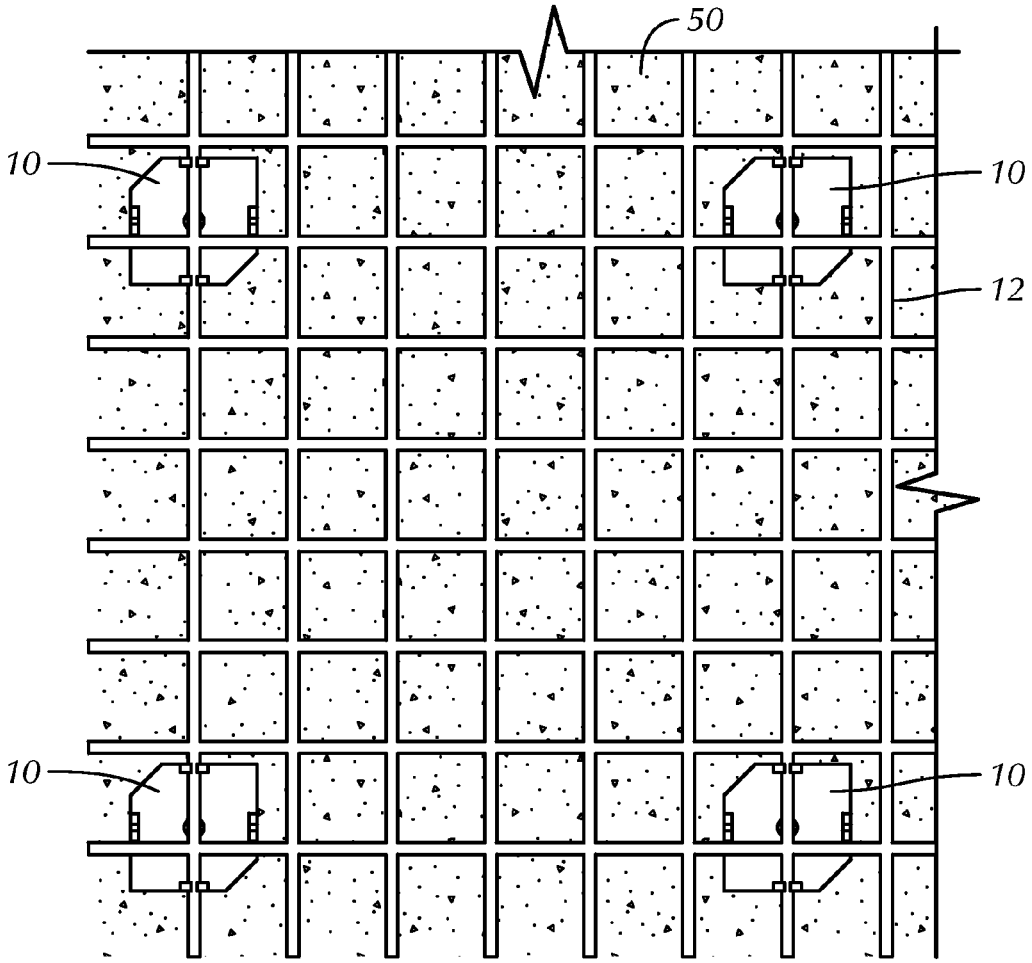
FIG. 8 is a top view of a portion of a composite slab having four support members supporting a layer of reinforcement material in accordance with an exemplary embodiment of the present invention.

Referring to FIGS. 7 and 8, using reinforcement material 12 in a slab 50 of composite material, such as concrete or asphalt, helps to strengthen slab 50. In one embodiment, reinforcement material 12 increases the strength of slab 50 by retarding reflective cracking of slab 50 by a factor of 2 to 3 times by turning crack stresses horizontally to dissipate the stress. Support member 10 may be used as part of a system or kit to support reinforcement material 12 above a surface or substrate 48 a desirable height while the composite material in a liquid state is poured over reinforcement material 12. Support member 10 may be used to keep reinforcement material 12 suspended within the liquid composite material until the composite material hardens into slab 50.

Referring to FIGS. 1A-6, support member 10 may include a generally horizontal base member 14 and at least one vertical leg member 16, 20, 24, 28 attached to base member 14. The first vertical leg member 16 may include a first opening 18 configured to receive at least one layer of reinforcement material 12. In one embodiment, first opening 18 is proximate a top end of first vertical leg member 16 and is open horizontally and in a direction opposite base member 14.

Support member 10 may include a second vertical leg member 20 attached to base member 14 and having a second opening 22 configured to receive at least one layer of reinforcement material 12. In one embodiment, second opening 22 is proximate a top end of second vertical leg member 20 and is open horizontally and in a direction opposite base member 14.

Support member 10 may include a third vertical leg member 24 opposite first vertical leg member 16. Third vertical leg member 24 may have a third opening 26 configured to receive at least one layer of reinforcement material 12. In one embodiment, third opening 26 is proximate a top end of third vertical leg member 24 and is open horizontally and in a direction opposite base member 14. In one embodiment, first opening 18 is horizontally aligned with third opening 26.

Support member 10 may include a fourth vertical leg member 28 opposite second vertical leg member 20. In one embodiment, fourth vertical leg member 28 includes a fourth opening 30 configured to receive at least one layer of a reinforcement material 12. In one embodiment, fourth opening 30 is proximate a top end of fourth vertical leg member 28 and is open horizontally and in a direction opposite base member 14. In one embodiment, second opening 22 is horizontally aligned with fourth opening 30.

In one embodiment, base member 14 is perpendicular to the vertical leg members 16, 20, 24, 28. In one embodiment, first, second, third, and fourth vertical leg members 16, 20, 24, 28 are spaced from and generally parallel to one another. In one embodiment, first and third vertical leg members 16, 24 are on opposing sides of base member 14. In one embodiment, first and third vertical leg members 16, 24 are spaced from one another a distance Y. In one embodiment, second and fourth second vertical leg members 20, 28 are on opposing sides of base member 14. In one embodiment, second and fourth second vertical leg members 20, 28 are spaced from one another a distance Y. In one embodiment, first, second, third, and fourth vertical leg members extend in the same direction from a top surface of base member 14. In one embodiment, first, second, third, and fourth vertical leg members are coupled to one another by base member 14 only.

In one embodiment, first vertical leg member 16 and third vertical leg member 24 have the same height relative to base member 14. For example, the height of first vertical leg member 16 and third vertical leg member 24 are about 1.5 inches to about 2.5 inches (38mm-63.5 mm), preferably about 2 inches (51.5 mm). In one embodiment, second vertical leg member 20 and fourth vertical leg member 28 have the same height relative to base member 14. For example, the height of second vertical leg member 20 and fourth vertical let member 28 may be about 0.5 inches to about 1.5 inches (13 mm-38 mm), and preferably about 1.25 inches (32 mm). The height of first and third vertical leg members 16, 24 relative to base member 14 may be taller than the height of second and fourth vertical leg members 20, 28 relative to base member 14. In one embodiment, the difference in height between first and third vertical leg members 16, 24 and second and fourth vertical leg members 20, 28 is about 0.5 inches to about 1.5 inches (13 mm-38 mm), and preferably about 0.75 inches (19 mm).

The openings of the first, second, third and fourth vertical leg members 16, 20, 24, 28 may be configured to receive two or more layers of reinforcement material 12 such that the reinforcement material 12 is doubled or tripled to increase the strength of reinforcement material 12 if desired. In one embodiment, one or more of at least one of first opening 18 in first vertical leg member 16, second opening 22 in second vertical leg member 20, third opening 26 in third vertical leg member 24, and fourth opening 30 in fourth vertical leg member 28 are configured to receive two or more overlapping layers of reinforcement material 12 as described below in Example 1. For example, the vertical height of a portion of one or more of first opening 18, second opening 22, third opening 26 and fourth opening 30 is 2 mm-10 mm, preferably 2 mm-6 mm, more preferably 5 mm.

In one embodiment of support member 10 according to the present invention, one or more of at least one of first opening 18 in first vertical leg member 16, second opening 22 in second vertical leg member 20, third opening 26 in third vertical leg member 24, and fourth opening 30 in fourth vertical leg member 28, has slanted top portions 42 where the top portions are slanted to a center gap 52 of each of the openings as shown in FIGS. 1A-1C, 3, 4 and 6, or rounded or curved top portions (not shown). In one embodiment of support member 10 according to the present invention, one or more portions 44 of one or more of vertical leg members 16, 20, 24, 28 adjacent each of first opening 18, second opening 22, third opening 26 and fourth opening 30, respectively, is flexible and can be biased toward and away from a center of each of such openings.

In one embodiment, one or more of first opening 18, second opening 22, third opening 26 and fourth opening 30 are configured to allow reinforcement material 12 to slide horizontally (see e.g. directions A and B in FIG. 4) relative to such openings.

In one embodiment gap 52 has a horizontal width that is less than the horizontal width of a strand 46 of reinforcement material 12. In one embodiment, gap 52 is slid horizontally over a strand 46 of reinforcement material 12 and once strand 46 passes through gap 52 and into an opening 18, 22, 26, 30, support member 10 may be rotated about strand 46 to a vertical or installation position. In one embodiment, one or more of first opening 18, second opening 22, third opening 26 and fourth opening 30 are configured in a partial hour glass or I-beam shape in cross section, to accommodate one or more strands of reinforcement material 12 and then hold such strand(s) in place in the bottom portion of the hour glass or I-beam configuration. In one embodiment, the bottom portion of one or more of first opening 18, second opening 22, third opening 26 and fourth opening 30 is rectangular. As set forth above, the vertical height of the bottom portion of the hour glass configuration is about 2 mm-about 6 mm, preferably 2 mm-3 mm, more preferably 2 mm.

In another embodiment according to the present invention, support member 10 includes a fastener system configured to engage base member 14 and secure base member 14 to a substrate 48. In one embodiment, substrate 48 is a pre-formed countertop support and typically includes concrete board such as DUROCK® cement board manufactured by USG Corporation.

In one embodiment of support member 10, the fastener system includes an adhesive layer 34 attached to base member 14. In one embodiment, adhesive layer 34 is of sufficient binding strength to attach support member 10 to substrate 48. For example, adhesive layer 34 is D/C Polyester Hi Performance adhesive manufactured by High Performance Tape Company in Windham, N.H. The fastener system may include an opening 36 in base member 14, where opening 36 is configured to accommodate a mechanical fastener 38 such as a screw. In one embodiment, mechanical fastener 38 is a concrete or wood screw. In one embodiment, opening 36 is generally aligned between first, second, third and fourth vertical leg members 16, 20, 24, 28. In one embodiment, the fastener system includes both adhesive layer 34 and opening 36. In another embodiment, the fastener system includes an adhesive layer 34 and no opening 36. In another embodiment, the fastener system includes an opening 36 and no adhesive layer 34. In another embodiment, the fastener system includes a different attachment mechanism. The fastener system may also be omitted.

Figure 3A:
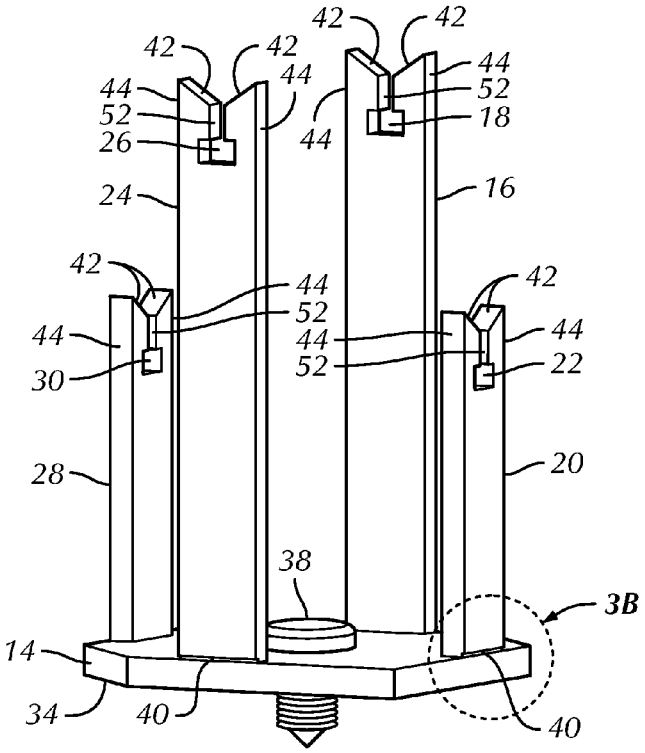
FIG. 3A is a perspective view of the support member of FIG. 1A with the fastener in place.
Figure 3B:
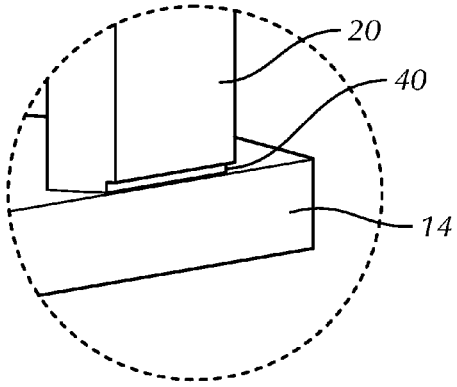
FIG. 3B is an enlarged perspective view of a portion of the support member shown in FIG. 3A.

In one embodiment, one or more of first, second, third and fourth vertical leg members 16, 20, 24, 28 is removably attached to base member 14. One or more of first, second, third and fourth vertical leg members 16, 20, 24, 28 may be configured to be removed from base member 14 without the use of a tool. One or more of first, second, third and fourth vertical leg members 16, 20, 24, 28 may include a horizontal notch 40 proximate base member 14 (FIGS. 3A and 3B). The notch 40 may be generally vertically aligned with a top surface of base member 14. Though, first, second, third and fourth vertical leg members 16, 20, 24, 28 having a notch 40 are of sufficient strength to support reinforcement material 12, notch 40 may be included as a line of weakness in one or more of the vertical leg members 16, 20, 24, 28 such that a user can remove a vertical leg member 16, 20, 24, 28 from base member 14. In one embodiment, one or more of the vertical leg members 16, 20, 24, 28 are removed from base member 14 by moving a top end of a vertical leg member 16, 20, 24, 28 relative to base member 14 until vertical leg member 16, 20, 24, 28 snaps or fractures along the horizontal notch 40. The one or more of the vertical leg members 16, 20, 24, 28 detached from base member 14 may be discarded. The one or more of the vertical leg members 16, 20, 24, 28 removed from base member 14 may have a different height from the remaining one or more of the vertical leg members 16, 20, 24, 28 such that only the vertical leg members 16, 20, 24, 28 having the desired height remain attached to base member 14.

In one embodiment, the present invention includes a kit including support member 10 for supporting reinforcement material 12 in a composite structure such a concrete slab 50 for use as a countertop in a kitchen or as another work space. The kit may include one or more support members 10 according to any of the embodiments described herein. In one embodiment, the kit includes support member 10 including base member 14, first and second vertical leg members 16 and 20, respectively, opposite and spaced a distance Y (See FIGS. 1A and 1B) from one another and having a first height relative to base member 14. In one embodiment, support member 10 includes first and second vertical leg members 16 and 20 including openings 18 and 22, respectively, configured to receive at least one layer of reinforcement material 12, as described herein. In one embodiment, support member 10 includes third and fourth vertical leg members 24 and 28, respectively, opposite and spaced a distance Y from one another and having a second height relative to base member 14 different from the first height of first and second vertical leg members 16 and 20. In one embodiment, third and fourth vertical leg members 24 and 28, respectively, each have an opening configured to receive at least one layer of reinforcement material 12, as described herein. In one embodiment, the kit further includes reinforcement material 12 configured to include a mesh of parallel and perpendicular strands 46 forming a grid, with each parallel strand being spaced a distance X (See FIG. 4) from one another. In one embodiment, distance X is less than distance Y to allow horizontal translation of reinforcement material 12 along a strand 46 of reinforcement material 12. This configuration allows reinforcement material 12 to pass by taller first and third vertical leg members 16 and 24, and snap into shorter second and fourth vertical leg members 20 and 28 without removing first and third vertical leg members 16 and 24. In one embodiment, distance X is 1 inch and distance Y is 1¼ inches. In one embodiment, the smallest horizontal dimension of base member 14 is greater than distance X. In one embodiment, support member 10 does not fit through the gaps in reinforcement material 12.

Figure 6:
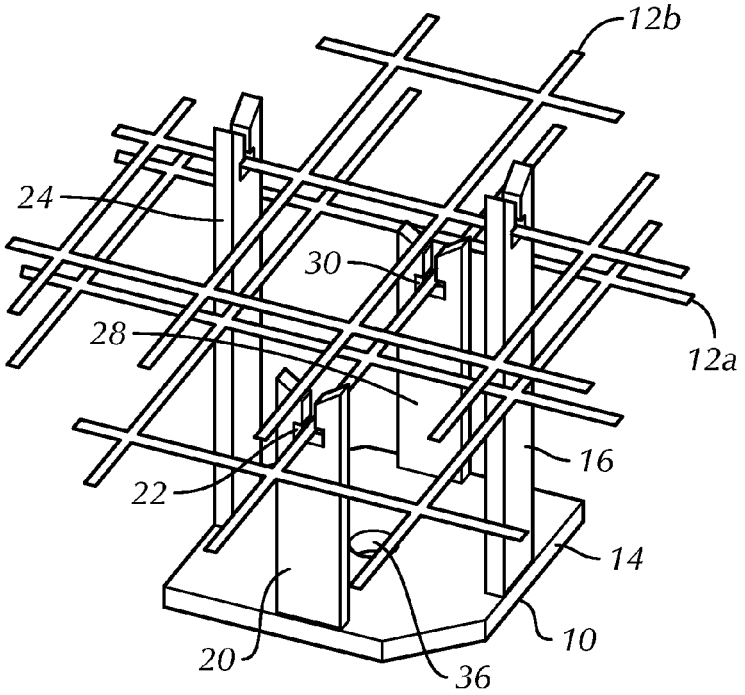
FIG. 6 is a perspective view of the support member shown in FIG. 5 attached to first and second layers of reinforcement material.

In one embodiment, support member 10 is coupled to reinforcement material 12 before support member 10 is secured to substrate 48. Support member 10 may be snapped onto reinforcement material 10 and horizontally shifted into place along a first strand 46 of reinforcement material with two opposing legs on opposite sides of a second strand 46 of reinforcement material, the second strand 46 being generally perpendicular to the first strand 46. Referring to FIG. 6, a first set of support members 10 having lower height legs 20, 28 may be coupled to a bottom layer of reinforcement material 12*a* and a second set of support members 10 having higher height legs 16, 24 may be placed below the bottom layer such that the legs 16, 24 extend through the bottom layer of reinforcement material 12. A top layer of reinforcement material 12*b* may then be coupled to the legs 16, 24 of the second layer of reinforcement material 12 such that the top layer of reinforcement material 12 is spaced above the bottom layer of reinforcement material 12. Referring to FIG. 7, vertical leg members not being utilized may be removed so that they do not get in the way. Support members 10 may be shifted horizontally if necessary and then secured to substrate 48 using a fastener such as an adhesive 34 and/or screw 38. Alternatively, support members 10 may be secured to substrate 48 and then reinforcement material 12 is coupled to support members 10.

Materials

Support member 10 may be manufactured in any preferred manner using any preferred material. Support member 10 may be molded. In one embodiment, support member 10 is injection molded. In one embodiment, support member 10 is, at least initially, a one piece integral device. In one embodiment support member 10 is made of a rigid or semi rigid material. Support member 10 may be comprised of plastic. In one embodiment, support member is comprised of a thermoplastic such as polyethylene, polypropylene, and/or polystyrene or another material such as polyvinyl chloride (PVC). In one embodiment support member 10 has a peened or roughened surface that promotes stability of support member 10 and adherence to a composite material such as concrete.

Figure 4:
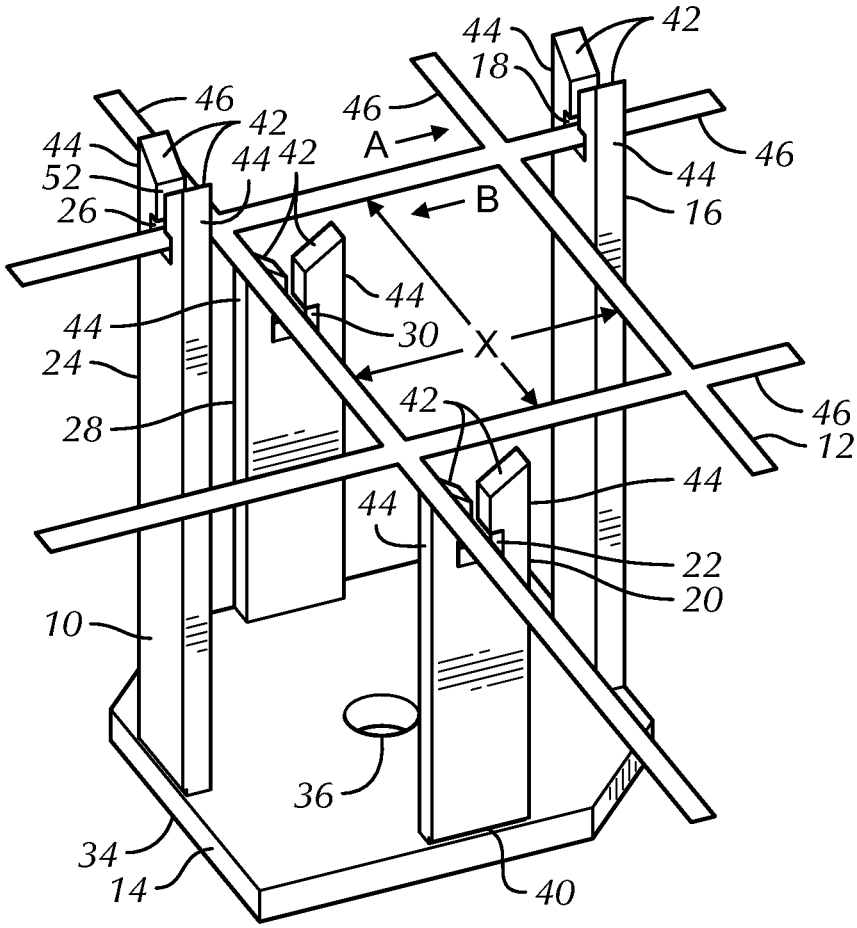
FIG. 4 is a perspective view of the support member shown in FIG. 1A attached to a layer of reinforcement material.
Figure 5:
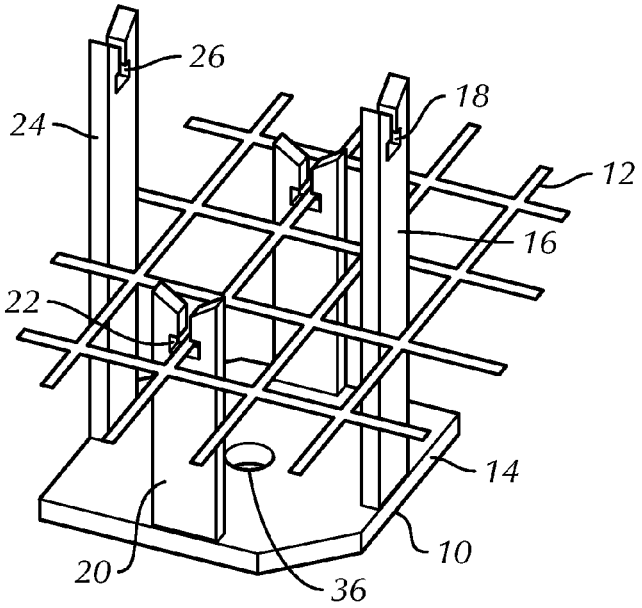
FIG. 5 is a perspective view of the support member shown in FIG. 1A attached to a first layer of reinforcement material.

Referring to FIGS. 4-6, reinforcement material 12 may be any material desired useful for adding strength to slab 50. In one embodiment, reinforcement material 12 is a grid of fiberglass material. Reinforcement material 12 may include fiberglass strands coated with an elastomeric polymer. In one embodiment, reinforcement material 12 is an X by X grid of parallel and perpendicular strands. In one embodiment, reinforcement material 12 is a 1 inch by 1 inch grid of parallel and perpendicular glass strands 46 having the dimensions and technical characteristics identified as SRG 45 from Saint Gobain Adfors. In one embodiment, reinforcement material 12 is a 1 inch by 1 inch grid of parallel and perpendicular glass strands 46 having the dimensions and technical characteristics identified as FG 50 from Concrete Countertop Solutions. In one embodiment, reinforcement material 12 is a ½ inch by ½ inch grid of parallel and perpendicular glass strands 46 having the same technical characteristics of SRG 45 or FG 50 but having a ½ inch by ½ inch grid of parallel and perpendicular glass strands. In one embodiment, reinforcement material 12 is in the form of sheets that are about 24 inches wide by 50 feet long. In one embodiment, support member 10 (as described herein) and/or reinforcement material 12 are made of or coated with a material (e.g., a modified acrylic polymer including an epoxy) that promotes stabilizing in and/or adherence of a composite material such as concrete to the surface of support member 10 and/or reinforcement material 12.

A kit may be provided that includes a support member 10 and reinforcement material 12. In some embodiments, a kit includes one or more of the items identified herein including one or more of the items shown in the following non-limiting example.

EXAMPLE

Materials for Concrete Countertop Installation as shown in FIGS. 7 and 8

1. Base DUROCK® or similar cement board base for substrate 48;

2. 10-1000 support members 10 to hold multiple layers of reinforcement material 12;

3. SRG 45 or FG 50 glass fabric reinforcement material 12 cut into 24 inch wide by 50 feet long lengths;

4. Countertop forms to form perimeter of the countertop; and 5. 60 lb. pre bagged concrete sand mix.

Concrete Countertop Installation Using Support Member 10

1. Cut reinforcement material 12 to fit inside of the formed countertop area. Overlap reinforcement material 12 by a minimum of 16" in all corners and areas that require reinforcement material 12 to be joined. Once all reinforcement material 12 is fit and cut to cover the entire countertop surface area it can be removed and set aside.

2. Choose the set of parallel legs on support member 10 to assure proper vertical height of reinforcement material 12 within the concrete slab as shown in FIG. 7. Note that both sets of parallel vertical legs on support member 10 may be used if two layers of reinforcement material 12 are desired in the concrete slab. If one layer of reinforcement material 12 is used, the unused vertical legs on support member 10 can be removed so that they are out of the way by snapping them off along notch 40.

3. Attach support member 10 to cement board substrate 48 with polyester mounting tape and/or a #12 half inch cement or wood screw. Support member 10 should be placed in a location where they will line up with the spacing pattern of reinforcement material 12.

4. Snap the previously cut reinforcement material 12 into the openings in the tops of the vertical legs of support member 10, placing two layers reinforcement material 12 in the openings of the vertical legs of support member 10 where the width of countertops (e.g., greater than 24 inches wide) requires more than one width of reinforcement material 12. Pull taut reinforcement material 12 while snapping into the tops of vertical legs of support member 10 to assure that the 45 reinforcement material 12 stays in its proper location while pouring concrete into the concrete countertop form.

5. Using the proper countertop concrete mix carefully pour the concrete through the reinforcement material 12. Allow concrete to cure.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the method does not rely on the particular order of steps set forth herein, the particular order of the steps should not be construed as limitation on the claims. The claims directed to the method of the present invention should not be limited to the performance of their steps in the order written, and one skilled in the art can readily appreciate that the steps may be varied and still remain within the spirit and scope of the present invention.

We claim:

1. A support member for supporting a reinforcement material in a composite structure, the reinforcement support member comprising:

a base member;

first and second vertical leg members on opposing sides of the base member and having a first height relative to the base member, the first and second vertical leg members each having an opening configured to receive at least one strand of the at least one layer of reinforcement material, third and fourth vertical leg members on opposing sides of the base member and having a second height relative to the base member different from the first height of the first and second vertical leg members, the third and fourth vertical leg members each having an opening configured to receive at least one strand of the at least one layer of reinforcement material, wherein the first, second, third, and fourth vertical leg members are coupled to one another by the base member only.

2. The support member of claim 1, wherein the first vertical leg member is configured to be removed from the base member without the use of a tool.

3. The support member of claim 2, wherein at least one of the first, second, third and fourth vertical leg members includes a horizontal notch proximate the base member.

4. The support member of claim 1, wherein the base member includes an opening configured to accommodate a mechanical fastener.

5. The support member of claim 4, wherein the opening is generally aligned between the first, second, third and fourth vertical leg members.

6. The support member of claim 1, wherein a bottom surface of the base member includes an adhesive layer.

7. The support member of claim 1, wherein at least one of the openings of the first, second, third and fourth vertical leg members is configured to receive two or more layers of the reinforcement material.

8. The support member of claim 1, wherein the first, second, third, and fourth vertical leg members are spaced from and generally parallel to one another.

9. A support member for supporting a reinforcement material in a composite structure, the reinforcement support member comprising:

a base member having an opening configured to receive a fastener;

first and second vertical leg members on opposing sides of the base member, the opening of the base member being generally aligned with the first and second vertical leg members, the first and second vertical leg members each having an opening configured to receive at least one strand of the at least one layer of reinforcement material, the first and second vertical leg members being coupled to one another by the base member only.

10. A kit for forming a composite structure comprising:

at least one layer of reinforcement material, each layer of the at least one layer of reinforcement material comprising a mesh of parallel and perpendicular strands forming a grid; and a support comprising:

a base member;

first and second vertical leg members on opposing sides of the base member and having a first height relative to the base member, the first and second vertical leg members each having an opening configured to receive at least one strand of the at least one layer of reinforcement material;

third and fourth vertical leg members on opposing sides of the base member and having a second height relative to the base member different from the first height of the first and second vertical leg members, the third and fourth vertical leg members each having an opening configured to receive at least one strand of the at least one layer of reinforcement material, wherein the first, second, third and fourth vertical leg members are each removeable from the base member, and wherein the first, second, third and fourth vertical leg members each include a notch proximate the base member, the notch being a line of weakness configured to break through the first, second, third or fourth vertical leg member when a top of the first, second, third or fourth vertical leg member is moved a sufficient distance relative to the base member.

11. The kit of claim 10, wherein the first and second vertical leg members are spaced a first distance from one another, the third and fourth vertical leg members are spaced a second distance from one another, each parallel strand of a layer of the reinforcement material being spaced a third distance from one another, at least one of the first and second distances being greater than the third distance.

12. The kit of claim 10, wherein the at least one layer of reinforcement material includes fiberglass.

13. A support member for supporting a reinforcement material in a composite structure, the reinforcement support member comprising:

a base member;

first and second vertical leg members on opposing sides of the base member and having a first height relative to the base member, the first and second vertical leg members each having an opening configured to receive at least one strand of the at least one layer of reinforcement material; and third and fourth vertical leg members on opposing sides of the base member and having a second height relative to the base member different from the first height of the first and second vertical leg members, the third and fourth vertical leg members each having an opening configured to receive at least one strand of the at least one layer of reinforcement material, wherein the first, second, third and fourth vertical leg members are each removeable from the base member, and the first, second, third and fourth vertical leg members each include a notch proximate the base member, the notch being a line of weakness configured to break through the first, second, third or fourth vertical leg member when a top of the first, second, third or fourth vertical leg member is moved a sufficient distance relative to the base member.

* * * * *